US010252403B2

(12) United States Patent
Chen

(10) Patent No.: US 10,252,403 B2
(45) Date of Patent: Apr. 9, 2019

(54) WRENCH ADJUSTABLE IN HEAD ANGLE

(71) Applicant: Chia-Yu Chen, Taichung (TW)

(72) Inventor: Chia-Yu Chen, Taichung (TW)

( * ) Notice: Subject to any disclaimer, the term of this patent is extended or adjusted under 35 U.S.C. 154(b) by 312 days.

(21) Appl. No.: 15/197,371

(22) Filed: Jun. 29, 2016

(65) Prior Publication Data

US 2018/0001445 A1 Jan. 4, 2018

(51) Int. Cl.

*B25B 23/00* (2006.01)
*B25G 1/06* (2006.01)
*B25B 13/46* (2006.01)

(52) U.S. Cl.

CPC ..... *B25B 23/0028* (2013.01); *B25B 13/46* (2013.01); *B25B 13/461* (2013.01); *B25G 1/063* (2013.01); *B25G 1/066* (2013.01)

(58) Field of Classification Search

CPC . B25B 13/461; B25B 23/0028; B25B 13/481; B25G 1/066; B25G 1/063

See application file for complete search history.

(56) References Cited

U.S. PATENT DOCUMENTS 5,768,960 A * 6/1998 Archuleta ..... B25G 1/066 403/84
5,771,761 A * 6/1998 Binkowski ..... B25B 13/28 81/111
6,857,341 B1 * 2/2005 Cheng ..... B25G 1/063 81/177.7
6,886,429 B1 * 5/2005 Lee ..... B25B 13/461 81/177.7
7,000,507 B1 * 2/2006 Lin ..... B25G 1/063 81/177.7
7,051,625 B1 * 5/2006 Lee ..... B25G 1/063 81/177.7
7,082,862 B2 * 8/2006 Lee ..... B25B 13/461 81/177.7
8,695,459 B2 * 4/2014 Lee ..... B25B 13/461 403/93
9,073,199 B2 * 7/2015 Hsieh ..... B25G 1/063
2011/0226099 A1 * 9/2011 Chen ..... B25B 13/04 81/177.8

* cited by examiner

*Primary Examiner* — Monica S Carter
*Assistant Examiner* — Danny Hong
(74) *Attorney, Agent, or Firm* — Ming Chow; Sinorica, LLC

(57) ABSTRACT

A wrench adjustable in head angle includes a pull lever having one end provided with an accommodating groove for receiving a spring and a resisting pin. The resisting pin is fitted thereon with a push member, and the pull lever is pivotally connected with a driving head. The resisting pin has one end elastically pushed by the spring to be engaged with one end of the driving head and the resisting pin is engaged with the push member. The push member can be pushed to actuate the resisting pin to press the spring, letting the resisting pin disengaged from the driving head for adjusting the angle of the driving head, convenient in operation.

5 Claims, 6 Drawing Sheets

WRENCH ADJUSTABLE IN HEAD ANGLE

BACKGROUND OF THE INVENTION

1. Field of the Invention

This invention relates to a wrench, particularly to one adjustable head angle.

2. Description of the Prior Art

A conventional moving head type ratchet wench 200, as shown in FIG. 1, includes a head 1, a pull lever 2, a spring 3 and a steel ball 4 combined together. The head 1 is formed with a pivotal portion 101 to be pivotally connected with the pull lever 2, and the pivotal portion 101 is provided with a plurality of ratchets 102. The pull lever 2 is bored with an accommodating groove 201 whose opening faces the ratchets 102, and the spring 3 and the steel ball 4 are orderly received in the accommodating groove 201. Thus, when a user is to adjust the angle of the head 1, the head 1 relative to the pull lever 2 is turned to a predetermined angle to have the spring 3 elastically pushing against the steel ball 4 to force the steel ball 4 to resist against the ratchets 102 for positioning the angle of the head 1. However, although the conventional moving head type ratchet wrench 200 can be operated to adjust the angle of the head 1, yet the steel ball 4 is impossible to be really engaged and firmly fixed with the head 1 and hence, when turned to an angle, the head 1 is still likely to be rotated relative to the pull lever 2. Moreover, even through another kind of moving head type ratchet wrench that can really position the angle of the head may be produced, more members will be undoubtedly added to the moving head type ratchet wrench to increase complexity of the structure, thus complicated in structure, inconvenient in operation and high in production cost. Therefore, having observed foresaid drawbacks, the inventor of this invention thinks that the conventional moving head type ratchet wrench 200 is necessary to be ameliorated and thus devises this invention.

SUMMARY OF THE INVENTION

This invention is devised to offer a wrench adjustable in head angle, simple in structure, convenient in operation and able to lower production cost.

The wrench adjustable in head angle in the present invention includes a pull lever having one end formed with an end face provided thereon with two lugs, which have a first opening formed therebetween. The pull lever has the end face axially provided with an accommodating groove, and the two lugs respectively and symmetrically disposed with a first pivot joint portion and further, the pull lever has another end formed with a holding portion. A spring and a resisting pin are orderly received in the accommodating groove, and the resisting pin has one end resisting against the spring and another end provided with an engaging portion and further, the resisting pin is formed with a first push portion. A push member consists of a positioning plate located at the first opening and bored with a positioning hole corresponding to the resisting pin for the resisting pin to be inserted therethrough and further, the positioning plate is provided with a second push portion corresponding with the first push portion of the resisting pin, the first push portion being elastically pushed by the spring to resist against the second push portion. The positioning plate has at least one side edge protruding out of the first opening and extending axially along the pull lever to form a push plate, which is tightly stuck to the pull lever. Further, a space is formed between the positioning plate and the end face of the pull lever for allowing the push member to move toward the end face. A driving head is formed with a pivot turning portion, which is provided with a second pivot joint portion corresponding to the first pivot joint portions for the driving head and the pull lever to be pivotally connected with each other. Furthermore, the pivot turning portion of the driving head is formed with a ratchet surface corresponding with the engaging portion of the resisting pin to enable the ratchet surface to be engaged with the engaging portion.

The wrench adjustable in head angle of this invention is by having the push plate pushed toward the holding portion to have the second push portion of the push member pushing against the first pus portion of the resisting pin, letting the push member actuate the resisting pin to press the spring. At this time, the positioning plate will be moved toward the space and the resisting pin will be disengaged from the driving head, thus, able to adjust the angle of the driving head. After the angle of the driving head is adjusted, the push member is released to have the spring elastically pushing against the resisting pin to actuate the first push portion of the resisting pin to resist against the second push portion of the push member and force the engaging portion of the resisting pin to be engaged with the ratchet surface of the driving head for fixing the driving head in position. By so designing, the wrench adjustable in head angle of this invention is convenient in adjusting and positioning the angle of the driving head, convenient in operation, simple in structure, easy in manufacturing and able to greatly lower production cost.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
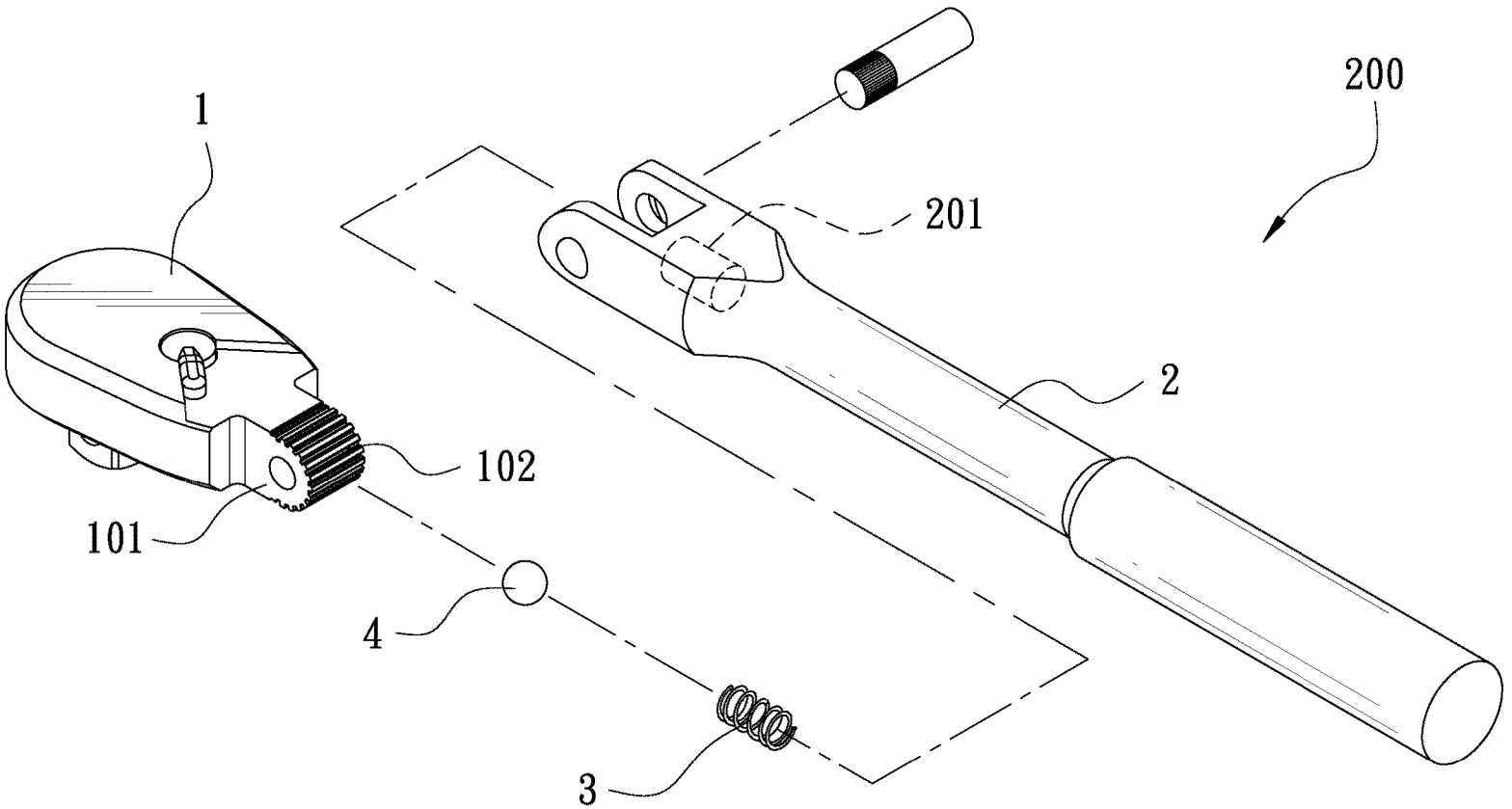
FIG. 1 PRIOR ART
FIG. 1 is an exploded perspective view of a conventional moving head type ratchet wrench.

A preferred embodiment of a wrench 100 adjustable in head angle in the present invention, as shown in FIGS. 2-5, includes a pull lever 10, a spring 20, a resisting pin 30, a push member 40 and a driving head 50 as main components combined together.

The pull lever has one end formed with an end face 11 provided thereon with two lugs 12, which have a first opening 13 formed therebetween, and the end face 11 is axially disposed with an accommodating groove 14 and the two lugs 12 are respectively and symmetrically provided with a first pivot joint portion 15. Further, the pull lever 101 has another end formed with a holding portion 16. In this preferred embodiment, the first pivot joint portion 15 is an insert hole.

The spring 20 is received in the accommodating groove 14.

The resisting pin 30 to be positioned in the accommodating groove 14 has one end resisting against the spring 20 and another end provided with an engaging portion 31, and the resisting pin 30 is further formed with a first push portion 32. In this preferred embodiment, the engaging portion 31 of the resisting pin 30 is a plurality of ratchets.

The push member 40 consists of a positioning plate 41 located at the first opening 13 and bored with a positioning hole 42 corresponding to the resisting pin 30 for the resisting pin 30 to be inserted therethrough. The positioning plate 41 is formed with a second push portion 43 corresponding with the first push portion 32 of the resisting pin 30, the first push portion 32 being elastically pushed by the spring 20 to resist against the second push portion 43. The positioning plate 41 has at least one side edge protruding out of the first opening 13 and extending axially along the pull lever 10 to form a push plate 44 to be tightly stuck to the pull lever 10. In addition, a space 45 is formed between the positioning plate 41 and the end face 11 of the pull lever 10 to allow the push member 40 to move toward the end face 11. In this preferred embodiment, the positioning plate 41 has two opposite side edges protruding out of the first opening 13 and respectively extending axially along the pull lever 10 to form the push plate 44, making the push member 40 almost U-shaped and forming a second opening 46, which faces the first opening 13 of the pull lever 10.

The driving head 50 is formed with a pivot turning portion 51, which is provided with a second pivot joint portion 52 corresponding with the first pivot join portion 15 for the driving head 50 and the pull lever 10 to be pivotally connected with each other. The pivot turning portion 51 of the driving head 50 is provided with a ratchet surface 511 corresponding with the engaging portion 31 of the resisting pin 30 to enable the ratchet surface 511 to be engaged with the engaging portion 31. In this preferred embodiment, the second pivot joint portion 52 is also an insert hole, and a pivot 53 is inserted through both the first pivot joint portion 15 and the second pivot joint portion 52 for pivotally connecting the pull lever 10 together with the driving head 50 so that the driving head 50, with the pivot 53 serving as an axis, can be turned relative to the pull lever 10, thus able to adjust the angle of the driving head 50.

Figure 2:
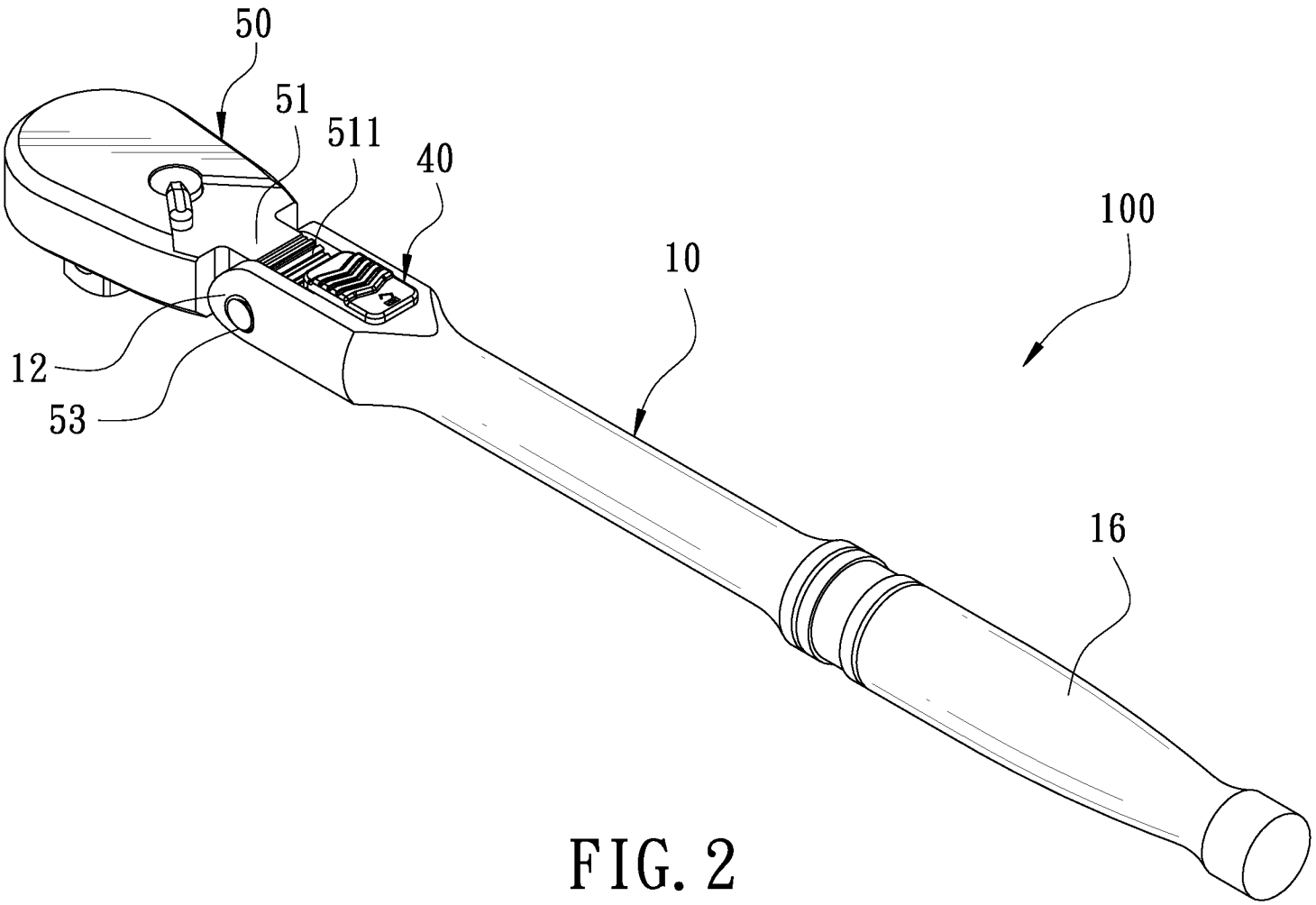
FIG. 2 is a perspective view of a wrench adjustable in head angle in the present invention.
Figure 3:
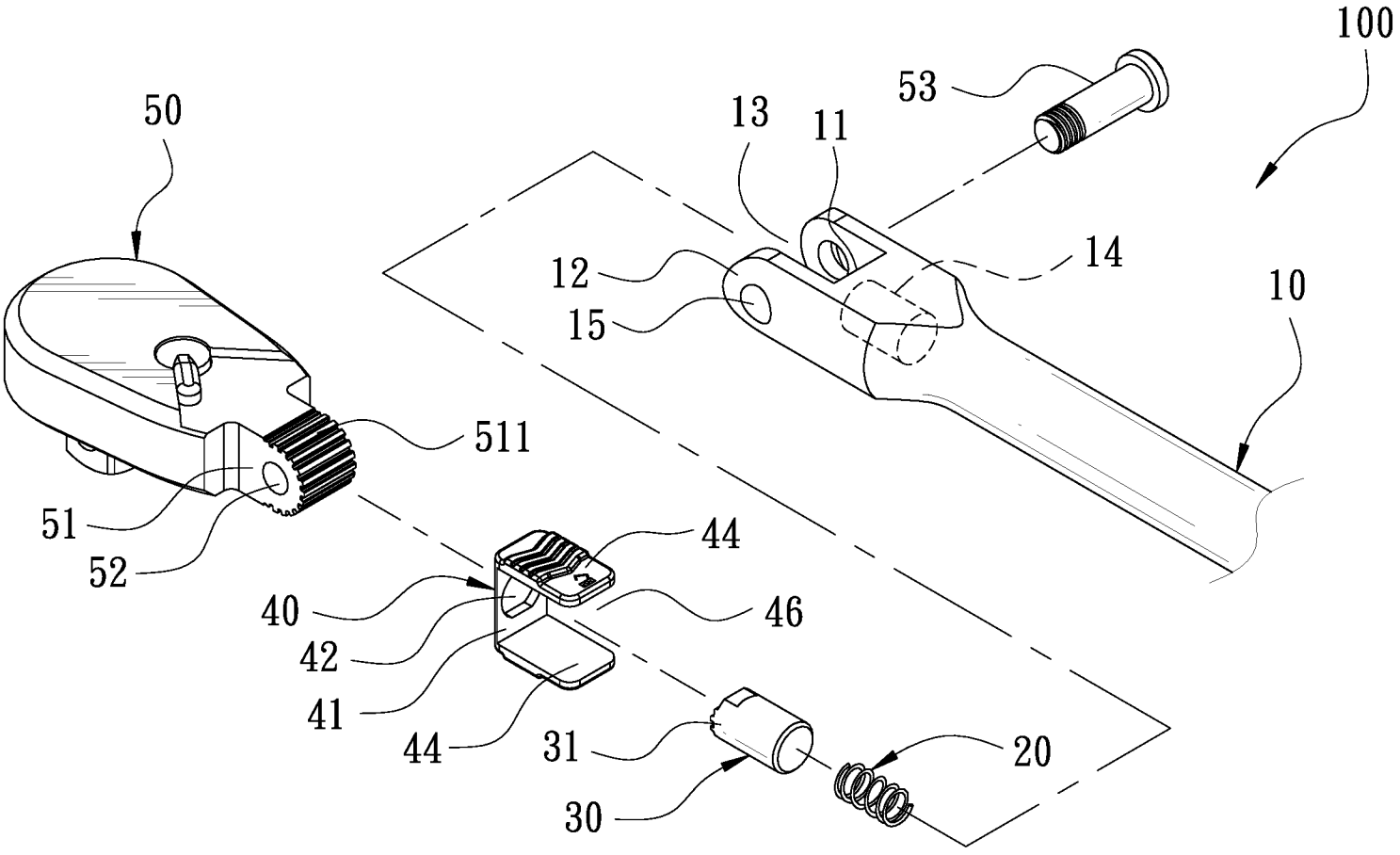
FIG. 3 is an exploded perspective view of the wrench adjustable in head angle in the present invention.
Figure 4:
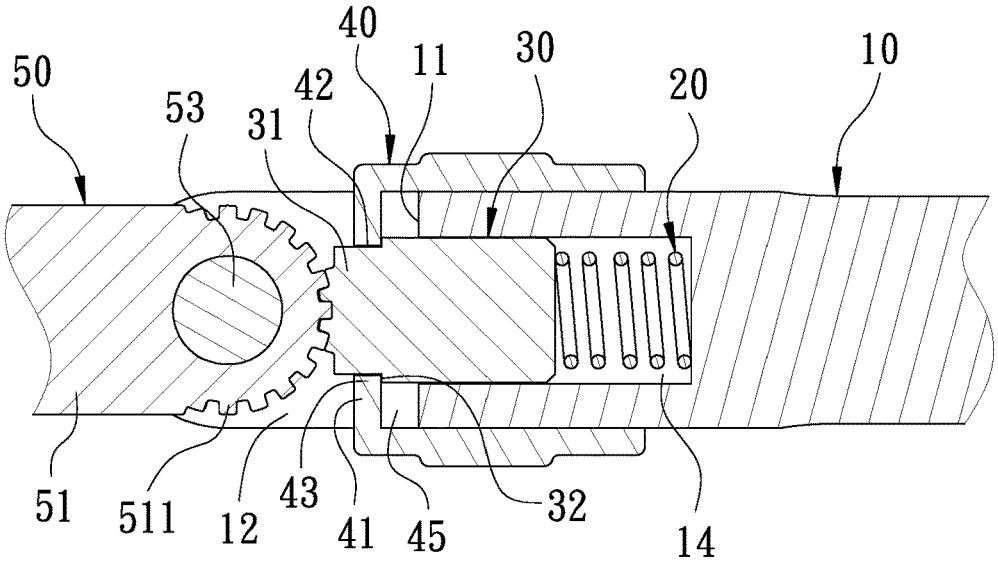
FIG. 4 is a partial cross-sectional view of the wrench adjustable in head angle in the present invention.
Figure 5:
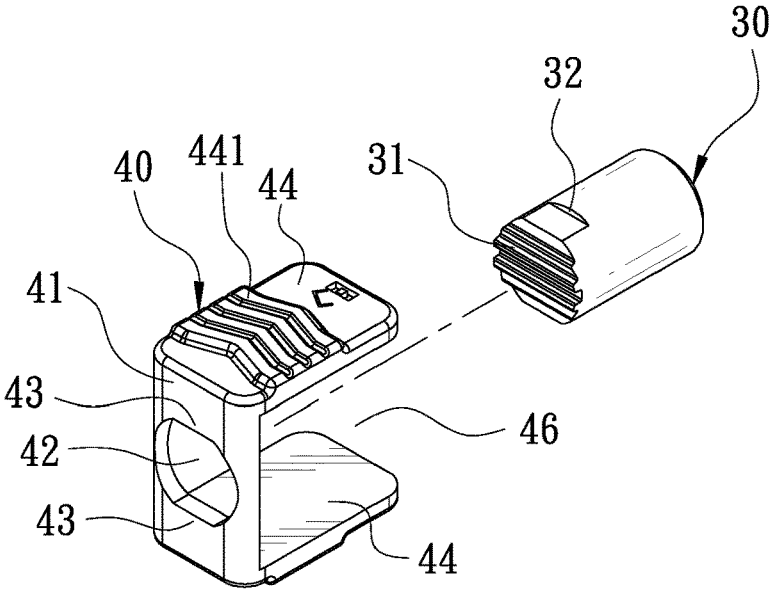
FIG. 5 is an exploded perspective view of a push member and a resisting pin of the wrench adjustable in head angle in the present invention.
Figure 6:
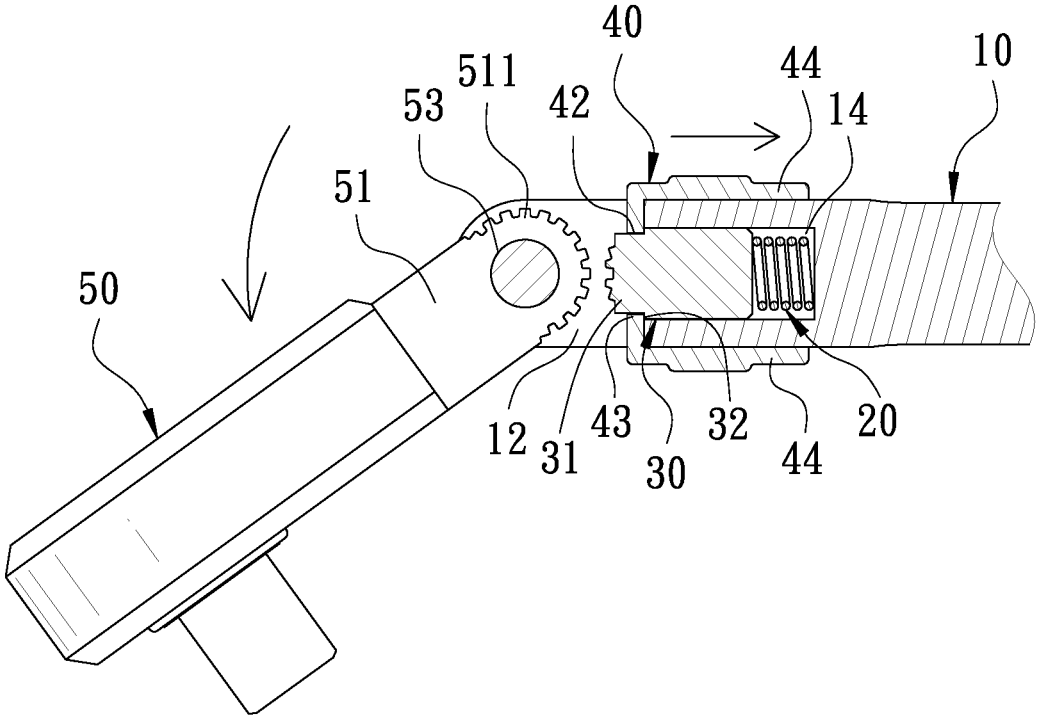
FIG. 6 is a cross-sectional view of a driving head disengaged from the resisting pin and turned for an angle in the present invention.
Figure 7:
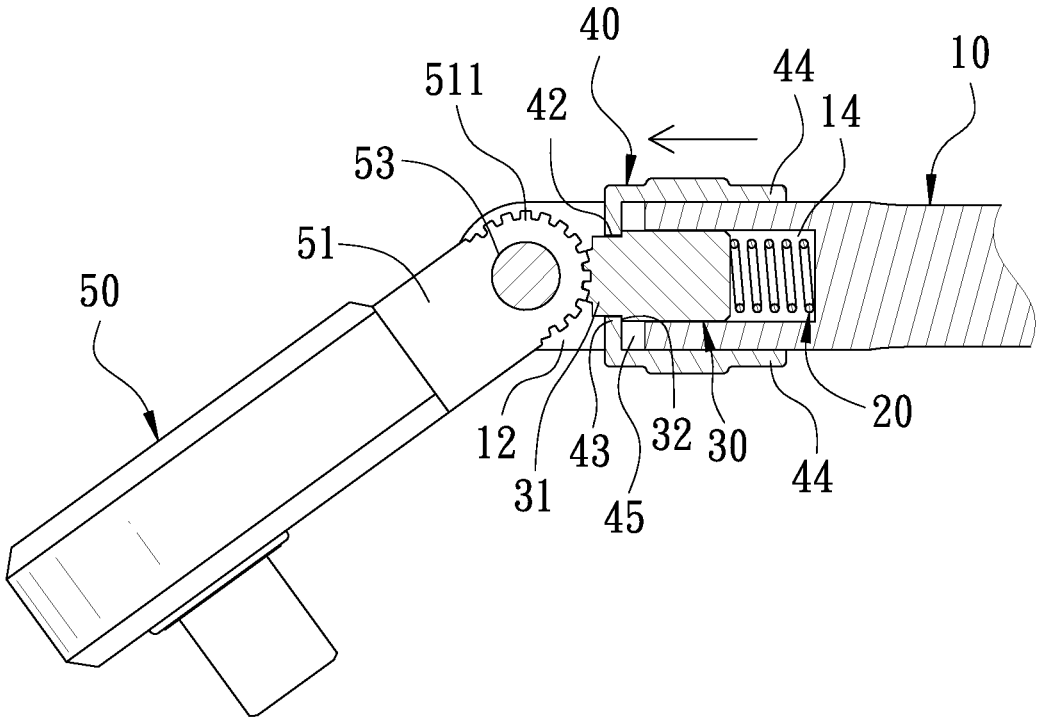
FIG. 7 is a cross-sectional view of positioning the angle of the driving head of the wrench adjustable in head angle in the present invention.

Referring to FIG. 5, the resisting pin 30 has two opposite sides of its outer circumferential edge respectively formed with a shoulder at a location adjacent to the engaging portion 31 to form the first push portion 32, and the positioning hole 42 of the positioning plate 41 has its circumferential wall provided with two stop blocks corresponding with the shoulders of the resisting pin 30 to form the second push portions 43 to enable the shoulders to resist against the stop blocks, letting the push member 40 and the resisting pin 30 actuated to push against each other for producing interaction effect. Under normal conditions, the driving head 10 of the wrench 100 is in a state as shown in FIGS. 2-4. To adjust the angle of the driving head 10, as shown in FIGS. 6 and 7, only have the push plate 44 pushed toward the holding portion 16 to make the second push portion 43 of the push member 40 resist against the first push portion 32 of the resisting pin 30, letting the push member 40 actuate the resisting pin 30 to press the spring 20. At this time, the positioning plate 41 will be moved toward the space 45 to let the engaging portion 31 of the resisting pin 30 disengaged from the ratchet surface 511 of the driving head 50 and thus, the driving head 50 can be turned to a predetermined angle, with the pivot 53 acting as an axis. After the angle of the driving head 50 is adjusted, the push member 40 is released to have the spring 20 elastically pushing against the resisting pin 30 to force the first push portion 32 to resist against the second push portion 43 of the push member 40 and actuate the engaging portion 31 of the resisting pin 30 to be engaged with the ratchet surface 511 of the driving head 50 for fixing the driving head 50 in position. Thus, a user can conveniently adjust and position the angle of the driving head 50 by operating the push member 40 to actuate the resisting pin 30 to be disengaged from or engaged with the driving head 50, convenient in operation. In addition, the wrench 100 adjustable in head angle of this invention is simple in structure, easy in manufacturing and able to greatly lower production cost.

One special feature of this invention is that each push plate 44 is fixed thereon with a projecting non-skid block 441, which has anti-skid effect and facilitates a user to push the push member.

Another special feature of this invention is that the engaging portion 31 of the resists pin 30 is a plurality of ratchets so that the resisting pin 30 can be firmly engaged with the ratchet surface 511 of the driving head 50.

While the preferred embodiment of the invention has been described above, it will be recognized and understood that various modifications may be made therein and the appended claims are intended to cover all such modifications that may fall within the spirit and scope of the invention.

What is claimed is:

1. A wrench adjustable in head angle comprising:

a pull lever having one end formed with an end face, said end face provided with two opposite lugs, said two lugs formed with a first opening therebetween, said end face of said pull lever axially provided with an accommodating groove, said two lugs respectively and symmetrically provided with a pivot joint portion, said pull lever having another end formed with a holding portion;

a spring received in said accommodating groove;

a resisting pin positioned in said accommodating groove, said resisting pin having one end resisting against said spring, said resisting pin having another end formed with an engaging portion, said resisting pin provided with a first push portion;

a push member consisting of a positioning plate located at said first opening, said positioning plate bored with a positioning hole corresponding with said resist pin for said resisting pin to be inserted therethrough, said positioning plate formed with a second push portion corresponding to said first push portion of said resist pin, said first push portion elastically pushed by said spring to resist against said second push portion, said positioning plate having at least one side edge protruding out of said first opening and extending axially along said pull lever to form a push plate, said push plate closely stuck to said pull lever, a space formed between said positioning plate and said end face of said pull lever to allow said push member to move toward said end face;

a driving head formed with a pivot turning portion, said pivot turning portion provided with a second pivot joint portion corresponding with said first pivot joint portion for said driving head and said pull lever to be pivotally connected with each other, said pivot turning portion of said driving head provided thereon with a ratchet surface corresponding with said engaging portion of said resisting pin, said ratchet surface able to be engaged with said engaging portion of said resisting pin;

thus, said push plate pushed toward said holding portion, said push member actuating said resisting pin to press said spring to let said resisting pin disengaged from said driving head for adjusting an angle of said driving head, said push plate released to have said resisting pin elastically pushed by said spring and engaged with said driving head for fixing said driving head in position; and said resisting pin has two opposite sides of outer circumferential edge respectively formed with a shoulder at a location adjacent to said engaging portion to form said first push portion, said positioning hole of said positioning plate having circumferential wall provided with two stop blocks corresponding to said shoulders to form said second push portion, said shoulder able to resist against said stop block to enable said push member and said resisting pin to push against each other and produce interaction effect.

2. The wrench adjustable in head angle as claimed in claim 1, wherein said positioning plate has two opposite side edges protruding out of said first opening and respectively extending axially along said pull lever to form said push plate, making push member almost U-shaped and forming a second opening, said second opening of said push member facing said first opening of said pull lever.

3. The wrench adjustable in head angle as claimed in claim 1, wherein said first pivot joint portion of said pull lever is an insert hole, and said second pivot joint portion of said pivot turning portion is also an insert hole, a pivot inserted through both said first pivot joint portion and said second pivot joint portion for pivotally connecting said pull lever with said driving head.

4. The wrench adjustable in head angle as claimed in claim 1, wherein said push plate is provided thereon with a non-skid block projecting outward.

5. The wrench adjustable in head angle as claimed in claim 1, wherein said engaging portion is a plurality of ratchets to enable said resisting pin to be engaged with said ratchet surface of said driving head.

* * * * *